US012041967B2

(12) United States Patent
Liu et al.

(10) Patent No.: US 12,041,967 B2
(45) Date of Patent: Jul. 23, 2024

(54) ELECTRIC HEATING DEVICE FOR PREVENTING CONTACT WEARING OUT AND TOBACCO FALLING OUT

(71) Applicant: CHINA TOBACCO HUBEI INDUSTRIAL CORPORATION LIMITED, Wuhan (CN)

(72) Inventors: Huachen Liu, Wuhan (CN); Yikun Chen, Wuhan (CN); Long Huang, Wuhan (CN); Welchang Ke, Wuhan (CN); Chenghao Luo, Wuhan (CN)

(73) Assignee: CHINA TOBACCO HUBEI INDUSTRIAL CORPORATION LIMITED, Wuhan (CN)

( * ) Notice: Subject to any disclaimer, the term of this patent is extended or adjusted under 35 U.S.C. 154(b) by 824 days.

(21) Appl. No.: 17/261,888

(22) PCT Filed: Jul. 23, 2018

(86) PCT No.: PCT/CN2018/096669
§ 371 (c)(1),
(2) Date: Sep. 17, 2021

(87) PCT Pub. No.: WO2020/019121
PCT Pub. Date: Jan. 30, 2020

(65) Prior Publication Data

US 2022/0279849 A1 Sep. 8, 2022

(51) Int. Cl.
*A24F 40/46* (2020.01)
*A24F 40/20* (2020.01)
*A24F 40/42* (2020.01)

(52) U.S. Cl.
CPC ..... *A24F 40/46* (2020.01); *A24F 40/20* (2020.01); *A24F 40/42* (2020.01)

(58) Field of Classification Search
CPC ..... A24F 40/46; A24F 40/20; A24F 40/42
(Continued)

(56) References Cited

U.S. PATENT DOCUMENTS 1,490,109 A 4/1924 Hort
1,549,887 A 8/1925 McMillin
(Continued)

FOREIGN PATENT DOCUMENTS

CN 103202537 7/2013
CN 107713009 2/2018
(Continued)

OTHER PUBLICATIONS

Search Report for International Patent Application PCT/CN2018/096669, mailed on Jan. 30, 2020.

*Primary Examiner* — Gary F Paumen
(74) *Attorney, Agent, or Firm* — FRESH IP PLC; Clifford D. Hyra; Aubrey Y. Chen

(57) ABSTRACT

The present disclosure provides an electric heating device including: a protective cover provided with an inner protrusions and an outer protrusions of the protective cover; a heating cavity, where the bottom of the heating cavity adopts a closing structure that is gradually narrowed, and includes an outer wall and an inner wall of the heating cavity, where the heating cavity outer wall is provided with a protrusions on the heating cavity outer wall, where the heating cavity inner wall is provided with a protrusions on the heating cavity inner wall; and a heating means located in the heating cavity, where the inner protrusions on the heating cavity outer wall are snap-fitted with the outer protrusions of the protective cover, and where the outer protrusions on the heating cavity inner wall are snap-fitted with the inner protrusions of the protective cover.

10 Claims, 2 Drawing Sheets

(58) Field of Classification Search
USPC ..... 131/329
See application file for complete search history.

(56) References Cited

U.S. PATENT DOCUMENTS

| | | | | |
|---|---|---|---|---|
| 2015/0034104 | A1* | 2/2015 | Zhou | A61M 15/02 131/329 |
| 2015/0342257 | A1* | 12/2015 | Chen | H05B 3/06 392/390 |
| 2016/0044965 | A1* | 2/2016 | Liu | A24F 40/50 392/394 |

FOREIGN PATENT DOCUMENTS

| | | | |
|---|---|---|---|
| CN | 108244711 | | 7/2018 |
| WO | 2013034453 | | 3/2013 |
| WO | 2016065521 | A1 | 5/2016 |
| WO | 2019140574 | A1 | 7/2019 |
| WO | 2020258385 | A1 | 12/2020 |

* cited by examiner

ELECTRIC HEATING DEVICE FOR PREVENTING CONTACT WEARING OUT AND TOBACCO FALLING OUT

TECHNICAL FIELD

The present disclosure relates to the technical field of novel tobacco, and in particular, to an electric heating device for preventing contact wear and tobacco falling.

BACKGROUND

In the field of heating non-combustion low-temperature cigarettes, the tobacco is heated by an external heat source, and the heating temperature is much lower than the burning temperature of cigarettes. In this way, the heating low-temperature cigarettes can significantly reduce a large number of harmful substances produced by cigarette burning, and it also can reduce harm of second-hand smoke to non-smokers. In a new type of cigarette where the tobacco product is heated by the external heat source heats, the tobacco product is heated to the atomization temperature to achieve the effect of generating smoke. In the above-mentioned new type cigarette where the tobacco product is heated by the external heat source, it is necessary to separate the cigarette and the heater from the heating cavity after the cigarette is heated. Therefore, it is necessary to provide the cigarette taking structure of the electric heating low-temperature cigarette appliance to prevent the cigarettes from being heated out and prevent the tobacco from staying in the heating cavity.

Currently, U.S. Pat. No. 5,144,962 describes an example of a heated smoking system. The advantages of these systems as an example are that they reduce sidestream smoke while allowing smokers to selectively suspend and restart smoking. U.S. Pat. No. 5,144,962 includes a flavor generating medium in contact with a heater in one embodiment; when the medium is exhausted, both it and the heater are replaced. Further, the electric heating device disclosed in the prior art includes the extractor for aerosol generating device proposed by Philip Morris Manufacturing Company in WO2013076098A3 PCT patent, in which the sliding receiver is in the sleeve and slidable between a first position and a second position. In the first position, the aerosol-forming matrix of the smoking article is positioned so as to be heated by the heater, and in the second position, the aerosol-forming matrix is substantially separated from the heater. The sliding receiver includes a support to support the aerosol-forming matrix of the smoking article as the sliding receiver and the smoking article are moving from the first position to the second position. It can be seen that this structure separates the cigarette from the heating cavity after the heating device is separated from the heated cigarette through a movement between the first position and the second position.

There are three very important technical problems in the prior art. First, the electric heating device described in the above prior art needs to make the heating cavity housing of the heating rod, the smoke lifting structure and the like laterally displaced relative to the heating device, and the position is limited by one or more contacts. Due to long-term use and lateral displacement, the contact in the electric heating device is seriously worn out, which is easy to cause the contact to loosen, and the cigarette lifting structure is prone to lateral displacement, which in turn drives the cigarette to loosen, and even causes the cigarette in a heated working stage to be separated from the heating element. The separated cigarettes can no longer be effectively inserted into the heating element, which greatly reduces the consumer experience. Second, the temperature in the heating cavity after heating exceeds 100° C., and the heating element temperature is higher. After the lateral displacement of the heating cavity housing and the smoke lifting structure, the parts close to the heating element or even the heating element are exposed, which may easily cause burns and other injuries. Third, when using the extraction structure in the aforementioned WO2013076098A3 PCT patent to extract cigarettes, there will be cases where the tobacco ends after being heated will fall off, so that after a certain period of use, the remaining tobacco will accumulate in the heating cavity, affecting with subsequent heating and suction effects, the cleaning frequency will also be greatly increased.

SUMMARY

The purpose of the present disclosure is to overcome the above-mentioned shortcomings and solve the above-mentioned technical problems. The present disclosure proposes an electric heating device that can prevent contact wear, improve safety and prevent tobacco falling.

An electric heating device includes: a protective cover provided with inner protrusions of the protective cover and outer protrusions of the protective cover; a heating cavity, the bottom of the heating cavity adopts a closing structure that is gradually narrowed, and includes an outer wall of the heating cavity and an inner wall of the heating cavity, the heating cavity outer wall is provided with protrusions on the heating cavity outer wall, the heating cavity inner wall is provided with a protrusions on the heating cavity inner wall; and a heating means located in the heating cavity; the inner protrusions on the heating cavity outer wall match with the outer protrusions of the protective cover, and the outer protrusions on the heating cavity inner wall match with the inner protrusions of the protective cover.

Further, the electric heating device includes a heating appliance, and the heating appliance includes a heating means and a controller; the heating cavity rotates around the heating means.

In one embodiment according to the present disclosure, the heating cavity rotates around the heating device, and a rotation angle is between 0-360°, and more preferably, the rotation angle is between 60-300°.

Further, after the heating cavity and the heating appliance are fixed to each other, the heating cavity fails or is difficult to be removed from the heating appliance without external force or other actions.

Optionally, the heating cavity is capable to be removed with a smaller external force when rotating from a first position to a second position. The first position is a position where the inner protrusions on the heating cavity outer wall and the outer protrusions of the protective cover are fully snap-fitted, and the second position is a position having a smaller snap-fitted area than the snap-fitted area when the inner protrusions on the heating cavity outer wall and the outer protrusions of the protective cover are fully snap-fitted. Preferably, the second position is a position where the inner protrusions on the heating cavity outer wall and the outer protrusions of the protective cover are not snap-fitted at all.

Further, the closing structure that is gradually narrowed starts closing at any position in the heating cavity.

In one embodiment according to the present disclosure, the closing position of the heating cavity of the closing structure that is gradually narrowed starts from an area containing the heating means in the heating cavity.

Further, the closing structure that is gradually narrowed is adopted by the bottom of the heating cavity, the heating cavity can be closed from any position of the heating cavity.

In one embodiment according to the present disclosure, the closing position of the heating cavity can start from an area containing the heating means in the heating cavity.

Optionally, the closing structure that is gradually narrowed is a linear closing or a an arc-shaped structure that is gradually narrowed.

To sum up, first of all, the present disclosure adds two sets of mutually matched protrusions, so that the heating cavity can rotate around the heating means. It is impossible or difficult to remove the heating cavity from the heating appliance without external force or other actions, thereby avoiding the lateral displacement of the smoke lifting structure relative to the heating device, and effectively preventing the heating rod from being easy to loose and falling off the smoke lifting structure after long-term use, and even driving the cigarette to fall off. The risk of burns and other injuries caused by high-temperature locations such as heating means are greatly reduced. Secondly, a closing structure that is gradually narrowed is adopted at the bottom of the heating cavity (the cavity where the cigarette is inserted), to deform and shrink the end of the cigarette. By wrapping the tobacco through the cigarette paper outside the cigarette, it can effectively prevent the tobacco in the end of the cigarette falling off, which effectively improves the suction effect and greatly reduces the frequency of consumers cleaning the heating cavity.

DESCRIPTION OF THE DRAWINGS

The accompanying drawings are used to provide a further understanding of the present disclosure, and constitute a part of the specification, together with the following specific embodiments to explain the present disclosure, but does not limit the present disclosure. In the attached figures.

In the figures.

1, battery; 2, housing; 3, controller; 4, inner protrusion on the heating cavity outer wall; 5, outer protrusion on the protective cover; 6, heating cavity outer wall; 7, linear closing; 8, heating cavity; 9, heating cavity inner wall; 10, heating means; 11, outer protrusion of the heating cavity inner wall; 12, inner protrusion of the protective cover; 13, control key; 14, arc-shaped closing; 15, protective cover.

DETAILED DESCRIPTION OF EMBODIMENTS

Embodiment 1

Figure 1:
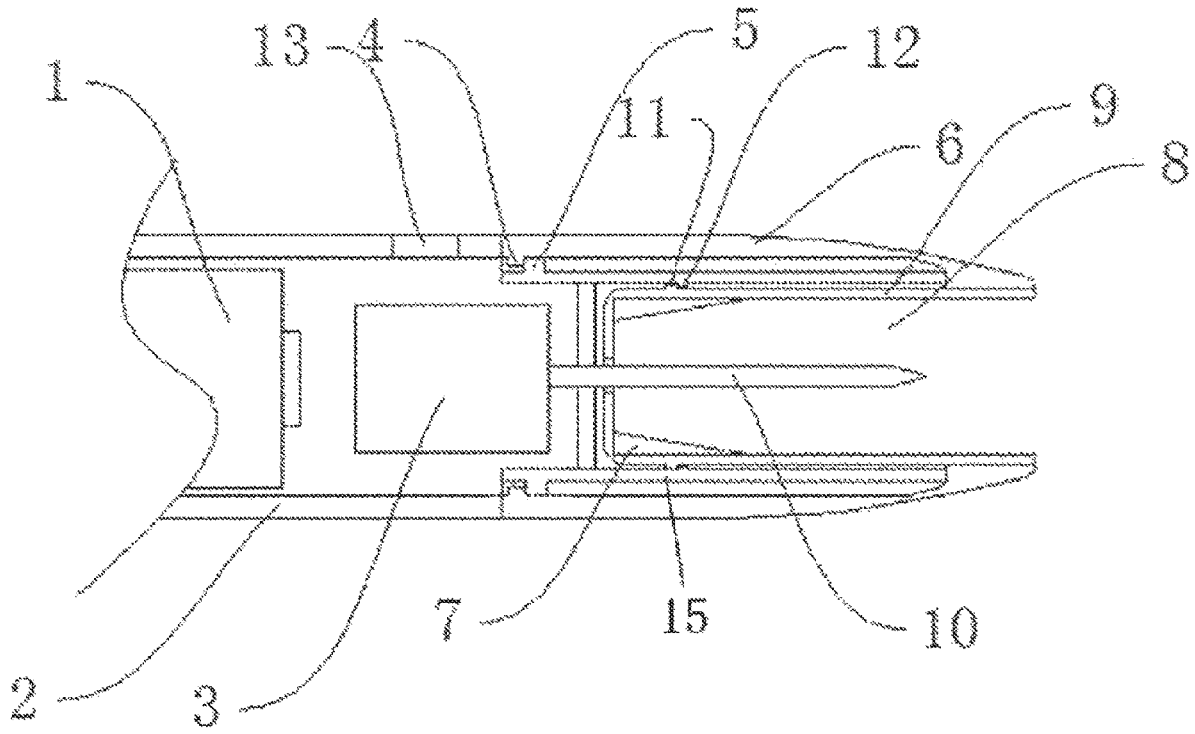
FIG. 1 illustrates a schematic cross-sectional view of a first embodiment according to the present disclosure.

FIG. 1 shows an electric heating device for an electronic cigarette as an embodiment according to the present disclosure. The electric heating device can be placed in the main power supply box or directly charged with an external power source as a separate electric heating device. The electric heating device may include a battery 1, a housing 2, a controller 3, and control keys 13. In the embodiment, the electric heating device may include a heating cavity outer wall 6, a heating cavity inner wall 9, a heating means 10, and a protective cover 15 for protecting the heating device. The heating cavity outer wall 6 may be provided with inner protrusions 4 on the heating cavity outer wall, and the inner protrusions 4 of the heating cavity outer wall may be matched with the outer protrusions 5 of the protective cover in a snap-fitted manner. The heating cavity inner wall 9 may be provided with an outer protrusion 11 on the heating cavity inner wall, and the outer protrusions 11 of the heating cavity inner wall may be matched with the inner protrusions 12 of the protective cover in a snap-fitted manner. As shown in FIG. 1, the heating cavity 8 of the electric heating device is connected to a heating appliance including a heating means 10 and a controller 3 through a buckle, and the heating cavity 8 can rotate around the heating means 10. At this time, after the heating cavity is snap-fitted with the heating appliance through the buckle, the heating cavity 8 and the heating appliance are integrated as a whole, and the heating cavity 8 cannot or is difficult to remove from the heating appliance without external force or other actions. The heating cavity 8 can rotate around the heating means 10, and the rotation angle is between 0° and 360°, for example, it can be 60°, 100°, or 300°. The bottom of the heating cavity 8 adopts a closing structure that is gradually narrowed. The closing position of the heating cavity 8 can start to close from any position in the heating cavity. Preferably, the closing position of the heating cavity 8 can start from any area in the heating cavity that contains heating means. As shown in FIG. 1, the closing of the heating cavity 8 can adopt a linear closing 7.

Embodiment 2

Figure 2:
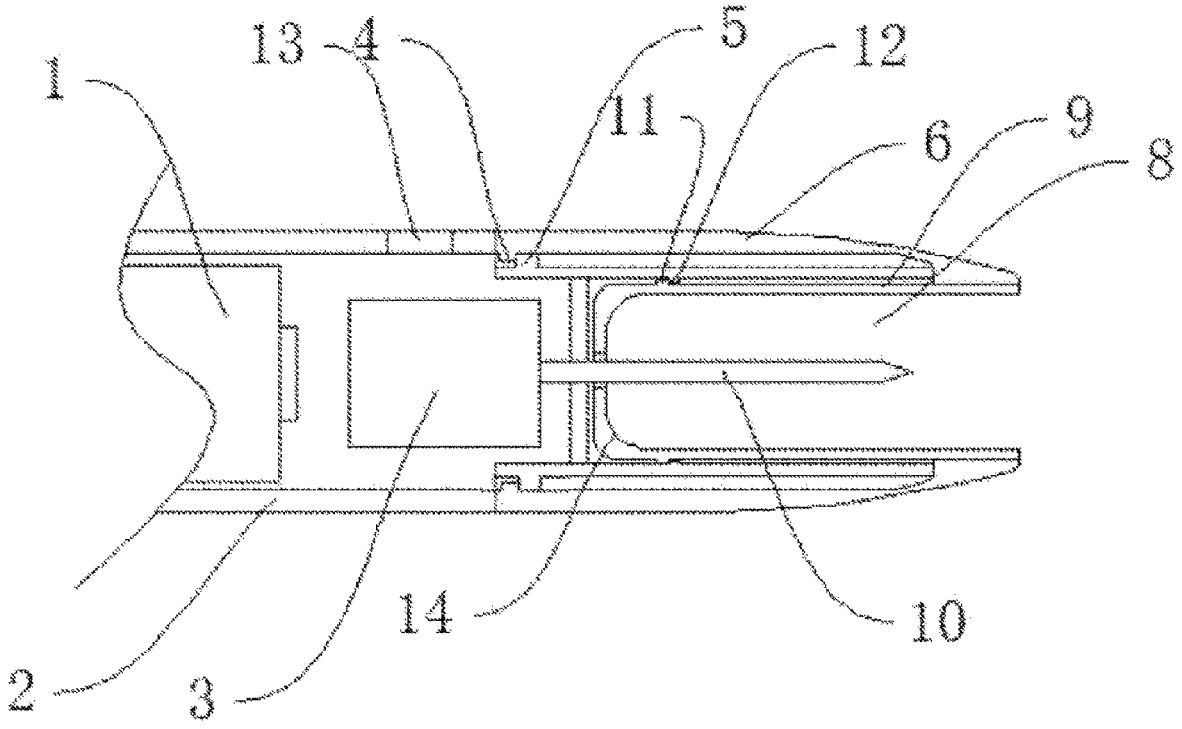
FIG. 2 illustrates a schematic cross-sectional view of a second embodiment according to the present disclosure.

FIG. 2 shows an electric heating device for an electronic cigarette as another embodiment according to the present disclosure. The above electric heating device can be placed in the main power box or directly charged with an external power source as a separate electric heating device. The electric heating device may include a battery 1, a casing 2, a controller 3, and control keys 13. In the embodiment, the electric heating device includes a heating cavity outer wall 6, a heating cavity inner wall 9, a heating means 10, and a protective cover 15 for protecting the heating device. The heating cavity outer wall 6 may be provided with inner protrusions 4 on the heating cavity outer wall, and the inner protrusions 4 of the heating cavity outer wall may be matched with the outer protrusions 5 of the protective cover in a snap-fitted manner. The heating cavity inner wall 9 may be provided with outer protrusions 11 on the heating cavity inner wall, and the outer protrusions 11 of the heating cavity inner wall may be matched with the inner protrusions 12 of the protective cover in a snap-fitted manner. As shown in FIG. 1, the heating cavity 8 of the electric heating device may be connected to a heating appliance including a heating means 10 and a controller 3 through a buckle, and the heating cavity 8 can rotate around the heating means 10. At this time, after the heating cavity is snap-fitted with the heating appliance through the buckle, the heating cavity 8 and the heating appliance are integrated as a whole, and the heating cavity 8 cannot or is difficult to remove from the heating appliance without external force or other actions. The heating cavity 8 can rotate around the heating means 10, and the rotation angle is between 0° and 360°, for example, it can be 70° or 120°. A closing structure that is gradually narrowed may be adopted in the bottom of the heating cavity 8. The closing position of the heating cavity 8 can start to close from any position in the heating cavity. Preferably, the closing position of the heating cavity 8 can start from any area in the heating cavity that contains heating means. As shown in FIG. 2, the closing of the heating cavity 8 adopts an arc-shaped closing 14.

The preferred embodiments of the present disclosure are described in detail above, but the present disclosure is not limited to the specific details in the aforesaid embodiments. Various simple modifications can be made to the technical solution of the present disclosure within the scope of the technical concept of the present disclosure, and these simple modifications all fall within the protection scope of the present disclosure.

In addition, it should be understood that the various specific technical features described in the aforesaid specific embodiments can be combined in any suitable manner without contradiction. In order to avoid unnecessary repetition, the various possible combinations are not described separately in the present disclosure.

The invention claimed is:

1. An electric heating device, the electric heating device comprising:

a protective cover provided with inner protrusions and outer protrusions;

a heating structure, a bottom of the heating structure adopting a closing structure that is gradually narrowed, including an outer wall of the heating structure and an inner wall of the heating structure, the outer wall being provided with protrusions thereon, the inner wall being provided with protrusions thereon; and a heating appliance located in the heating structure;

the protrusions on the outer wall being snap-fitted with the outer protrusions, and the protrusions on the inner wall being snap-fitted with the inner protrusions.

2. The electric heating device according to claim 1, wherein the heating appliance comprises a heater and a controller, and wherein the heating structure rotates around the heater.

3. The electric heating device according to claim 2, wherein the outer wall of the heating structure and the inner wall of the heating cavity rotate around the heater, with a rotation angle ranging from 0 degrees to 360 degrees.

4. The electric heating device according to claim 3, wherein the rotation angle ranges from 60 degrees to 300 degrees.

5. The electric heating device according to claim 2, wherein, after the heating structure and the heating appliance are fixed to each other, the heating structure cannot be removed from, or is difficult to be removed from, the heating appliance without external force or other actions.

6. The electric heating device according to claim 1, wherein the heating structure is capable to be removed with a smaller external force when rotating from a first position to a second position.

7. The electric heating device according to claim 1, wherein the closing structure that is gradually narrowed starts closing at any position in the heating structure.

8. The electric heating device according to claim 7, wherein the position starts from an area containing the heater in the heating structure.

9. The electric heating device according to claim 1, wherein the closing structure that is gradually narrowed is linear.

10. The electric heating device according to claim 1, wherein the closing structure that is gradually narrowed is an arc-shaped structure.

* * * * *